US006983114B2

(12) United States Patent
Arimitsu

(10) Patent No.: US 6,983,114 B2
(45) Date of Patent: Jan. 3, 2006

(54) PROCESS CARTRIDGE WHOSE DRUM-SHUTTER SUPPORTING PORTIONS ARE OUTSIDE THE OPTICAL PATH OF LIGHT EXPOSING A PHOTOSENSITIVE DRUM, AND ELECTROPHOTOGRAPHIC IMAGE FORMING APPARATUS DETACHABLY ATTACHING SUCH A PROCESS CARTRIDGE

(75) Inventor: Takeshi Arimitsu, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 94 days.

(21) Appl. No.: 10/687,806

(22) Filed: Oct. 20, 2003

(65) Prior Publication Data

US 2004/0081483 A1 Apr. 29, 2004

(30) Foreign Application Priority Data

Oct. 22, 2002 (JP) ..... 2002-307332

(51) Int. Cl.
*G03G 21/18* (2006.01)

(52) U.S. Cl. ..... 399/114; 399/113

(58) Field of Classification Search ..... 399/114, 399/113, 111

See application file for complete search history.

(56) References Cited

U.S. PATENT DOCUMENTS

| | | | | |
|---|---|---|---|---|
| 5,729,796 | A | 3/1998 | Miura et al. | 399/114 |
| 5,749,027 | A * | 5/1998 | Ikemoto et al. | 399/113 |
| 5,890,036 | A * | 3/1999 | Karakama et al. | 399/111 |
| 5,946,531 | A | 8/1999 | Miura et al. | 399/111 |
| 6,002,896 | A | 12/1999 | Miyamoto et al. | 399/114 |
| 6,055,406 | A | 4/2000 | Kawai et al. | 399/360 |
| 6,061,538 | A | 5/2000 | Arimitsu et al. | 399/111 |
| 6,144,821 | A | 11/2000 | Oguma | 399/114 |
| 6,169,866 | B1 * | 1/2001 | Watanabe et al. | 399/111 |
| 6,282,390 | B1 | 8/2001 | Miyabe et al. | 399/111 |
| 6,351,620 | B1 | 2/2002 | Miyabe et al. | 399/111 |
| 6,459,869 | B2 | 10/2002 | Nittani et al. | 399/111 |
| 6,463,234 | B2 | 10/2002 | Arimitsu et al. | 399/113 |
| 6,560,425 | B1 * | 5/2003 | Lui et al. | 399/114 |
| 2002/0110385 | A1 * | 8/2002 | Terada et al. | 399/111 |
| 2002/0110388 | A1 | 8/2002 | Yokomori et al. | 399/167 |
| 2002/0131790 | A1 * | 9/2002 | Sato et al. | 399/111 |
| 2003/0086715 | A1 | 5/2003 | Miura et al. | 399/27 |
| 2003/0156856 | A1 | 8/2003 | Arimistu et al. | 399/114 |
| 2003/0161654 | A1 | 8/2003 | Yokomori et al. | 399/111 |
| 2003/0185587 | A1 | 10/2003 | Kawai et al. | 399/111 |
| 2003/0223772 | A1 * | 12/2003 | Kubota | 399/114 |

FOREIGN PATENT DOCUMENTS

JP 7-230197 A 8/1995

(Continued)

*Primary Examiner*—Susan Lee
(74) *Attorney, Agent, or Firm*—Fitzpatrick, Cella, Harper & Scinto

(57) ABSTRACT

A process cartridge detachably attachable to a main body of an electrophotographic image forming apparatus includes an electrophotographic photosensitive drum, a developing roller developing an electrostatic latent image on the drum, a movable drum shutter for protecting the drum, a first frame body rotatably supporting the drum, a second frame body swingably coupled to the first frame body and rotatably supporting the developing roller, an optical path provided between the first frame body and the second frame body for passing light from the main body to the drum, and supporting portions swingably supporting the drum shutter provided on one end and on the other end in the longitudinal direction of the first frame body, the supporting portions being disposed between the first frame body and the second frame body and on the outside of the optical path in the longitudinal direction.

5 Claims, 14 Drawing Sheets

FOREIGN PATENT DOCUMENTS

| | | | |
|---|---|---|---|
| JP | 8-16067 | | 1/1996 |
| JP | 8-286509 | A | 11/1996 |
| JP | 9-44060 | A | 2/1997 |
| JP | 2000-89567 | | 3/2000 |

* cited by examiner

PROCESS CARTRIDGE WHOSE DRUM-SHUTTER SUPPORTING PORTIONS ARE OUTSIDE THE OPTICAL PATH OF LIGHT EXPOSING A PHOTOSENSITIVE DRUM, AND ELECTROPHOTOGRAPHIC IMAGE FORMING APPARATUS DETACHABLY ATTACHING SUCH A PROCESS CARTRIDGE

BACKGROUND OF THE INVENTION

1. Field of the Invention

The present invention relates to a process cartridge detachably attachable to an electrophotographic image forming apparatus for forming an image on a recording medium, and to an electrophotographic image forming apparatus.

2. Related Background Art

In the electrophotographic image forming apparatus using an electrophotographic image forming process, a process cartridge system has conventionally been adopted, in which an electrophotographic photosensitive member and process means for acting on the electrophotographic photosensitive member are integrated into a cartridge, which is made detachably attachable to a main body of the image forming apparatus. This process cartridge system allows the maintenance of the apparatus to be carried out not by a service person but by the user itself, significantly improving the operability. Therefore, the process cartridge system has been widely used in the image forming apparatus.

In the process cartridge, a protecting member is provided for preventing a photosensitive drum from deteriorating due to exposure to light, and the adhesion of dust and the like when the cartridge is detached from the apparatus main body (refer to, for example, Japanese Patent Application Laid-Open No. 8-16067 and Japanese Patent Application Laid-Open No. 2000-89567).

SUMMARY OF THE INVENTION

The present invention further develops the prior art examples. An object of the present invention is to provide a process cartridge that prevents a drum shutter from becoming accidentally detached from the frame bodies of the process cartridge and an electrophotographic image forming apparatus to which the process cartridge is detachably attachable.

Another object of the present invention is to provide a process cartridge which is smaller in size and an electrophotographic image forming apparatus to which the process cartridge is detachably attachable.

A further object of the present invention is to provide a process cartridge detachably attachable to a main body of an electrophotographic image forming apparatus, comprising:

an electrophotographic sensitive drum;

a developing roller for developing an electrostatic latent image formed on the electrophotographic photosensitive drum;

a drum shutter movable between a protecting position for protecting the electrophotographic photosensitive drum and a retracting position retracted from the protecting position;

a first frame body for rotatably supporting the electrophotographic photosensitive drum;

a second frame body for rotatably supporting the developing roller, the second frame body being swingably coupled to the first frame body;

an optical path provided between the first frame body and the second frame body for passing light from the main body of the electrophotographic image forming apparatus to the electrophotographic photosensitive drum; and supporting portions for swingably supporting the drum shutter provided on one end and on the other end in the longitudinal direction of the first frame body, the supporting portions being disposed between the first frame body and the second frame body and on the outside of the optical path in the longitudinal direction; and an electrophotographic image forming apparatus to which the process cartridge is detachably attachable.

DESCRIPTION OF THE PREFERRED EMBODIMENTS

The embodiments according to the present invention will now be described in detail with reference to the drawings. In the following description, the longitudinal direction of a process cartridge means the direction that intersects with the direction for attaching the process cartridge to and detaching the process cartridge from the apparatus main body (generally an orthogonal direction, orthogonal to an axis direction of an image bearing member); and the direction that is parallel to the surface of a recording medium and (generally orthogonally) intersects the direction for conveying the recording medium. In addition, right and left means the right and the left, respectively, when the recording medium is viewed from above following the conveying direction of the recording medium. Further, the upper surface of the process cartridge means the surface that is located in the upper position of the cartridge in the state where the process cartridge is mounted on the apparatus main body and the lower surface means the surface located in the lower position of the process cartridge.

Figure 1:
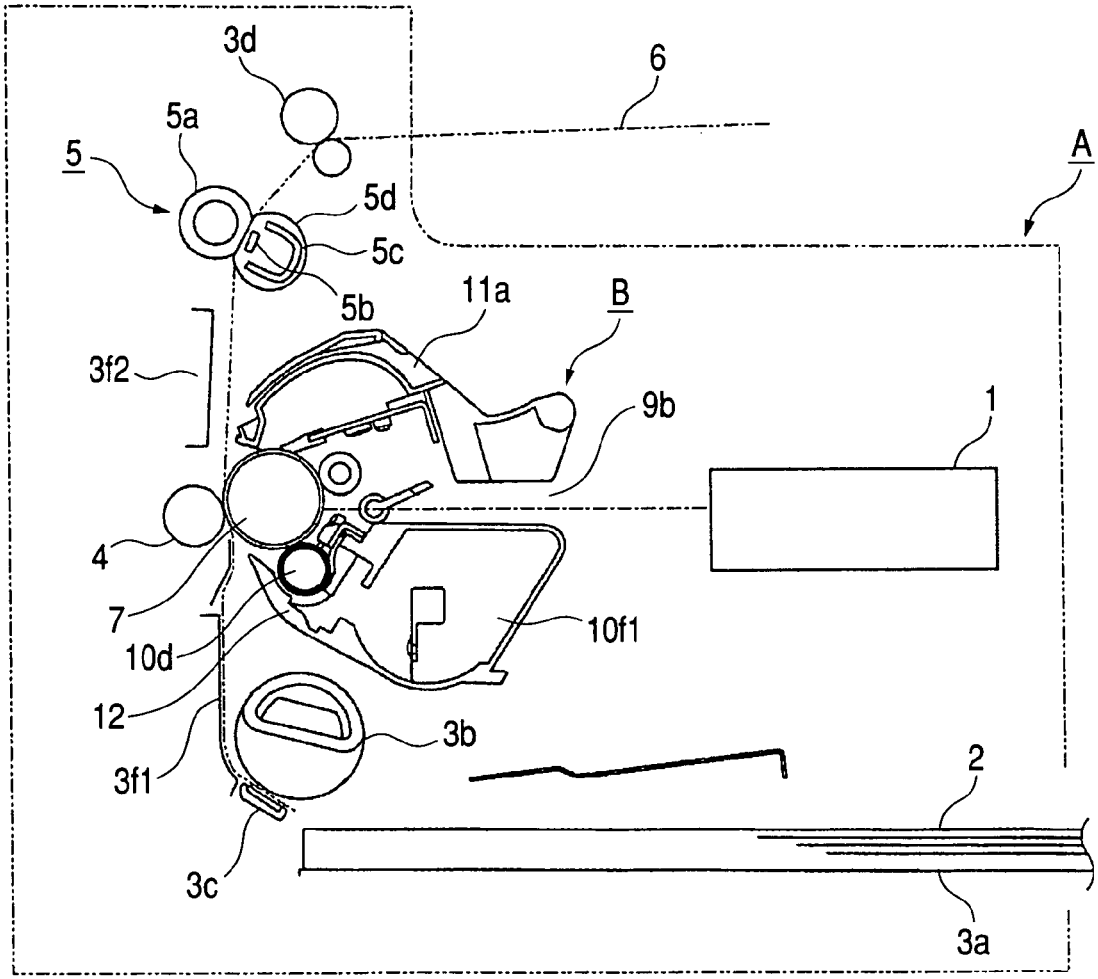
FIG. 1 is a sectional view schematically illustrating the construction of an electrophotographic image forming apparatus.
Figure 2:
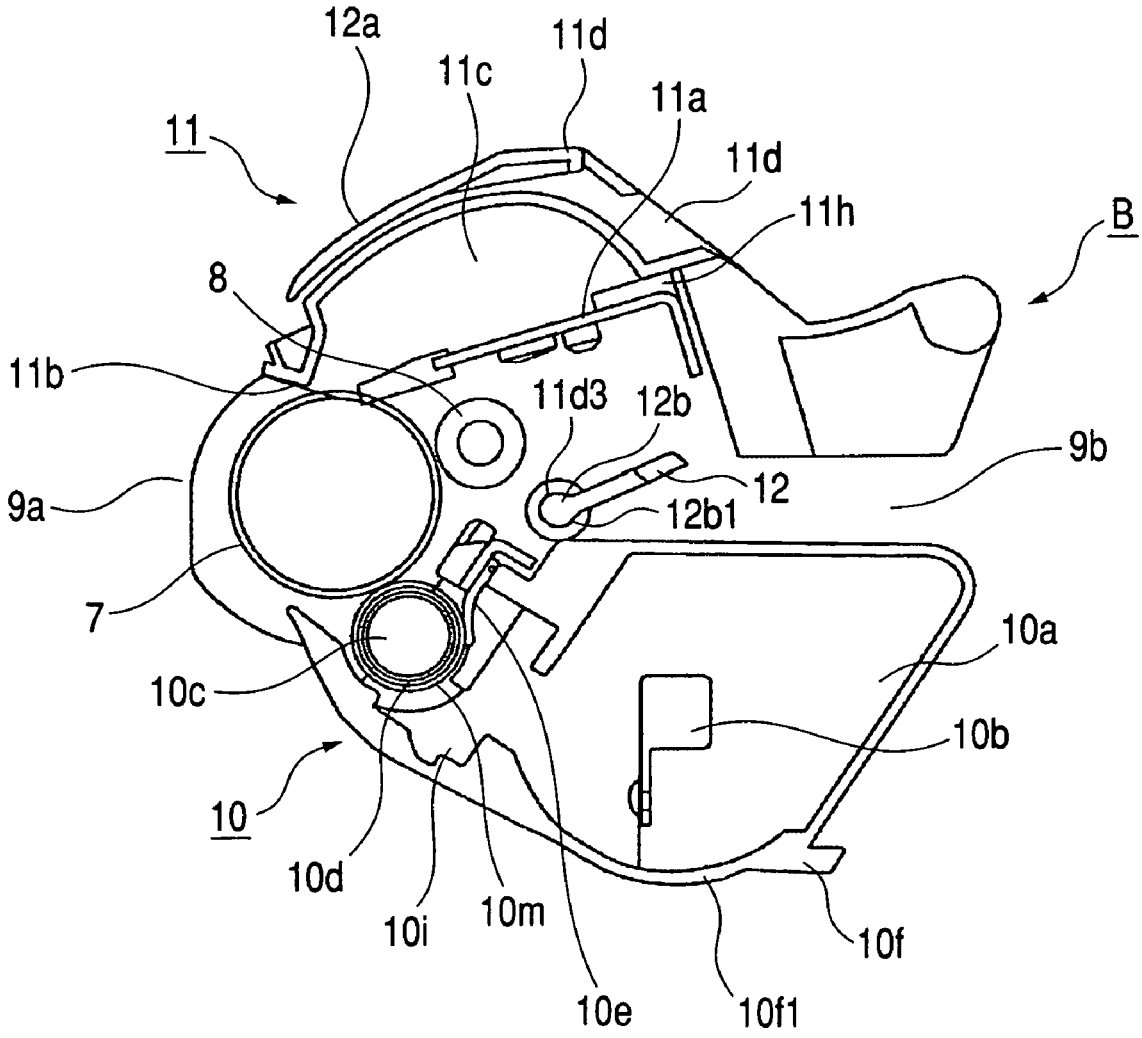
FIG. 2 is a sectional view schematically illustrating the construction of a process cartridge.

First, the process cartridge and the electrophotographic image forming apparatus to which the process cartridge is detachably attachable will be described in detail with reference to FIGS. 1 and 2. FIG. 1 is a constitutional explanatory schematic drawing of an electrophotographic image forming apparatus and FIG. 2 is a constitutional explanatory schematic drawing of a process cartridge. Here, in the order of description, the overall construction of a process cartridge and an electrophotographic image forming apparatus using the same will be described first, and then the process cartridge attaching/detaching-construction for attaching and detaching the process cartridge to the main body of the electrophotographic image forming apparatus will be described.

(Overall Construction)

The electrophotographic image forming apparatus (laser beam printer, hereinafter referred to as the "image forming apparatus") A, as shown in FIG. 1, irradiates a drum-shaped electrophotographic photosensitive member (hereinafter referred to as the "photosensitive drum") 7 with the information light based on image information from an optical system 1 as optical means to form an electrostatic latent image on the photosensitive drum 7. The electrostatic latent image is developed with a developer (hereinafter referred to as the "toner") to form a toner image. In synchronization with the formation of the toner image, a recording medium (a recording paper, an overhead transparency sheet, a cloth or the like) 2 is separated and fed one by one from a cassette 3*a* with a pickup roller 3*b* and a press-contact member 3*c* which is in press-contact with the same. The recording medium 2 is conveyed along a conveying guide 3*f*1 to a process cartridge B. The toner image formed on the photosensitive drum 7 is transferred to the recording medium 2 by applying voltage to a transferring roller 4 as transferring means. The recording medium 2 on which the toner image is transferred is conveyed along a conveying guide 3*f*2 to fixing means 5. The fixing means 5 has a drive roller 5*a* and a fixing rotating member 5*d* comprised of a cylindrical sheet with a built-in heater 5*b* and rotatably supported by a support member 5*c*. Heat and pressure are applied to the passing recording medium 2 to fix the transferred toner image. The recording medium 2 is conveyed by a discharging roller 3*d* and discharged through a reverse conveying path to a discharging portion 6. Note that the pickup roller 3*b*, the press-contact member 3*c* and the discharging roller 3*d* constitute conveying means 3 in the present embodiment.

(Process Cartridge)

The process cartridge B is provided with an electrophotographic photosensitive drum and at least one process means. The process means include, for example, electrostatic charging means for charging the electrophotographic photosensitive drum, developing means for developing the electrostatic latent image formed on the electrophotographic sensitive drum, cleaning means for cleaning the residual toner on the electrophotographic sensitive toner and the like. In the present embodiment, as shown in FIG. 2, the electrophotographic sensitive drum 7 having a photosensitive layer is rotated. Then, the surface of the photosensitive drum 7 is uniformly charged by applying voltage to the electrostatic charging roller 8 that is electrostatic charging means. The charged photosensitive drum 7 is exposed to the information light based on the image information from the optical system 1 (optical image) through an exposing opening 9*b*. Thus, the electrostatic latent image is formed on the surface of the photosensitive drum 7. The electrostatic latent image is developed by the developing means 10.

The developing means 10 carries the toner in a toner containing portion 10*a* using a rotatable carrying member 10*b* that is toner carrying means. Then, a developing roller 10*d* with a built-in stationary magnet 10*c* that is a developing rotating member (developer carrying member) is rotated, and the toner layer in which frictional charge is generated by a developing blade 10*e* is formed on the surface of the developing roller 10*d*. The toner is then transferred to the photosensitive drum 7 corresponding to the electrostatic latent image. Thereby, the toner image is visualized by forming it on the photosensitive drum 7.

The transferring roller 4 is then applied with the voltage having the polarity opposite to the toner image to transfer the toner image to the recording medium 2. After the transfer, a cleaning blade 11*a* scrapes the residual toner off the photosensitive drum 7. The scraped toner is then scooped with a scooping sheet 11*b* and collected in a removed toner containing portion 11*c*. The residual toner on the photosensitive drum 7 is removed by the cleaning means 11 having the cleaning blade 11*a* and the scooping sheet 11*b*.

The process cartridge B shown in the present embodiment rotatably supports the photosensitive drum 7 and has a cleaning frame body 11*d* (first frame body) incorporating the cleaning means 11 and the electrostatic charging roller 8 and a toner developing frame body 10*f* (second frame body) incorporating the developing means 10 and the toner containing portion 10*a*. The toner developing frame body 10*f* is swingably supported relative to the cleaning frame body 11*d* so that the developing roller 10*d* in the developing means 10 can be opposed in parallel to the photosensitive drum 7 with a specific clearance. Spacers 10*m* (refer to FIG. 7) for keeping the clearance between the developing roller 10*d* and the photosensitive drum 7 are provided at both ends of the developing roller 10*d*. Holder members 10*g* are provided at both sides of the toner developing frame body 10*f*. And the toner developing frame body 10*f* has hanging arms 10*g*7 in which coupling holes 10*g*8 for rotatably hanging the developing unit from the cleaning unit are formed. A certain pressure is applied to the developing unit (second frame body) and the cleaning unit (first frame body) for keeping the clearance between them.

Figure 3:
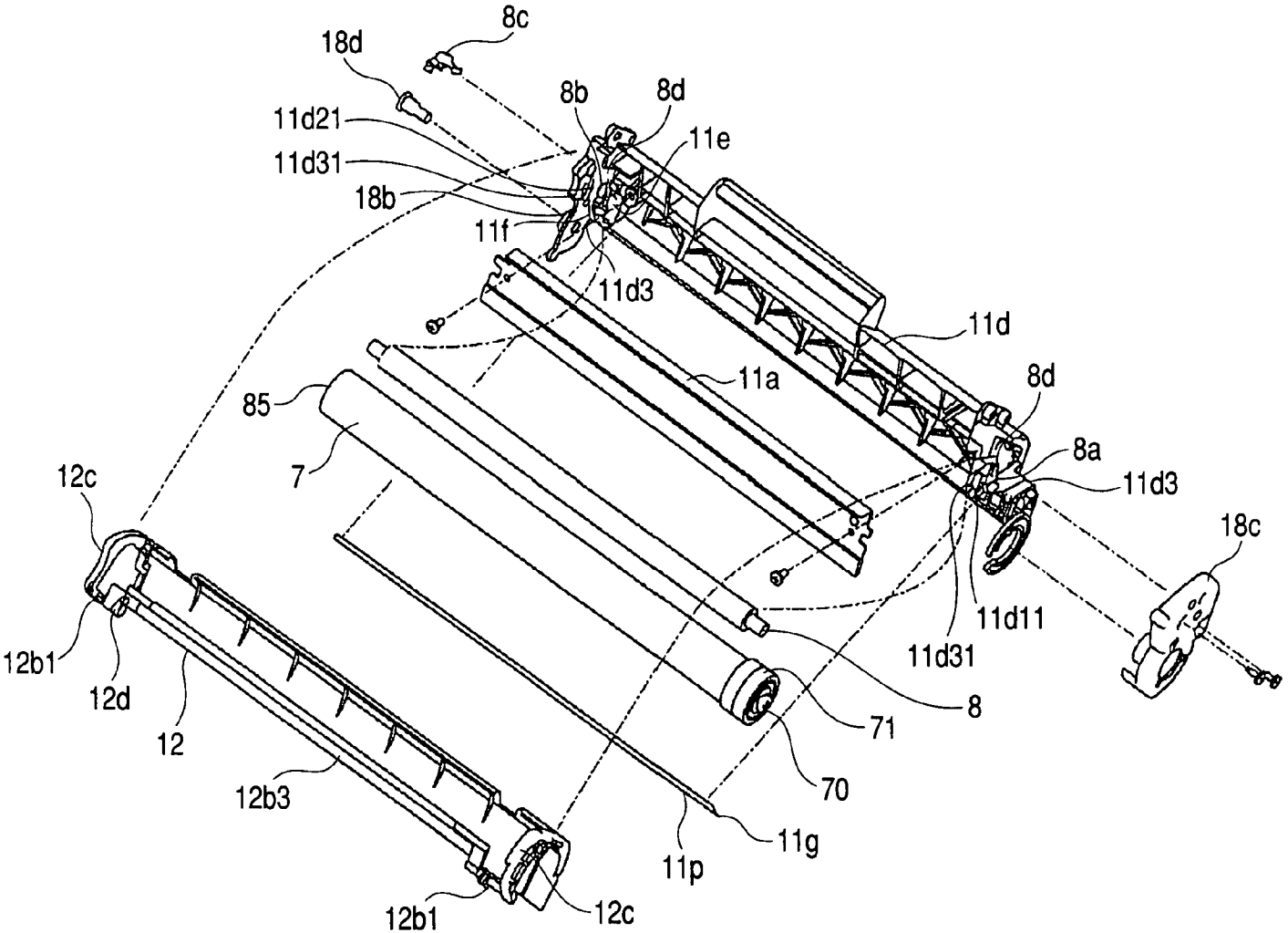
FIG. 3 is an assembly perspective view of a cleaning means.
Figure 4:
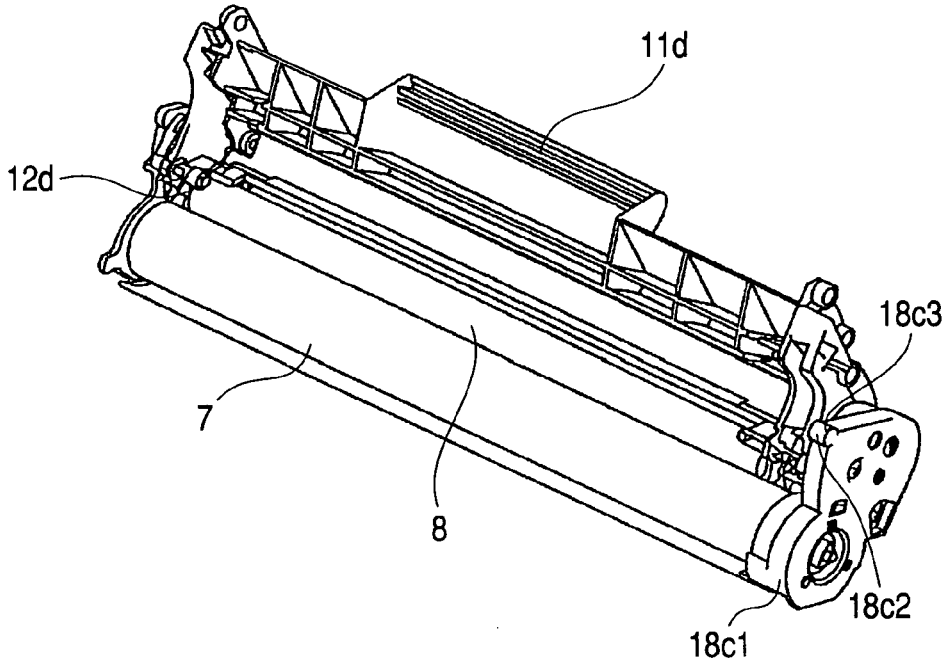
FIG. 4 is a perspective view 1 of cleaning means.

The construction of the cleaning means 11 will now be described in detail with reference to FIGS. 2, 3 and 4.

In the cleaning means 11, a first sealing member 11*e* which prevents the toner from the back side at both ends of the rubber of the cleaning blade 11*a* from leaking from the removed toner containing portion 11*c* and a second sealing member 11*h* which prevents the toner leakage at the backside of the cleaning blade are fixed with double-faced tapes and the like at specific positions of the cleaning frame body 11*d*. The cleaning blade is fastened with screws at a specific position of the cleaning frame body 11*d*, preventing the toner from leaking from both ends of the rubber of the cleaning blade 11*a*. A third sealing member 11*f* as a member for wiping deposits on the photosensitive drum such as toner and the scooping sheet 11*b* are fixed with double-faced tapes 11*g* and the like on the cleaning frame body 11*d*. In addition, an electrode 8*c* for supplying electricity to the electrostatic charging roller 8 from the main body of the image forming apparatus A is inserted in the cleaning frame body 11*d*.

Further, a roller bearing 8*b* which supplies electricity from the electrode 8*c* to the electrostatic charging roller 8 and serves as a bearing and the other bearing 8*a* are mounted in the cleaning frame body. The shaft of the electrostatic charging roller 8 is inserted into the bearings 8*b* and 8*a*.

The photosensitive drum 7 is coupled on one end with coupling means 70 for transferring a drive force and a drum gear 71 in which a gear for transferring the received drive force to the developing roller 10 and the transferring roller 4, a grounding contact and the like are integrated. In addition, the photosensitive drum 7 is coupled on the other end with a flange 85 having a bearing. The photosensitive drum 7 is supported by being pressed to the cleaning frame body 11*d* such that a bearing 18*c* is fastened with screws to the side of the coupling means 70 and a dowel pin 18*d* fits into a locating portion 18*b* on the other side.

In the process cartridge B of the present embodiment, a drum shutter 12 which can integrally cover a transferring opening 9*a* for the photosensitive drum opposed to the transferring roller and an exposing opening 9*b* is rotatably mounted on the cleaning frame body 11*d*. The construction of the drum shutter 12 will now be described. The drum shutter 12 has a drum protecting portion 12*a* capable of covering the transferring opening 9*a* in which the photosensitive drum 7 abuts the transferring roller 4. A rotating shaft 12*b* to be rotatably supported in the neighborhood of the electrostatic charging roller 8 in the cleaning frame body 11*b* is provided with sliding portions 12*b*1 which slide with the cleaning frame body 11*b* at both ends of the rotating shaft 12*b* and a portion 12*b*3 for connecting the sliding portions 12*b*1 at the both ends. The drum shutter 12 has connecting portions 12*c* provided at two locations in the right and left which connect both ends of the drum protecting portion 12*a* and the rotating shaft 12*b* at the outside of them. A rib 12*e* is provided which is disposed on the outside of the rotating shaft 12*b*1, provided on the right connecting portion 12*c* and extends to the outside in the longitudinal direction of the drum shutter 12. The rib 12*e* is received by a shutter guide Gb9 of a guide Gb provided in the main body of the image forming apparatus to keep the attitude that the drum shutter 12 is open.

Figure 5:
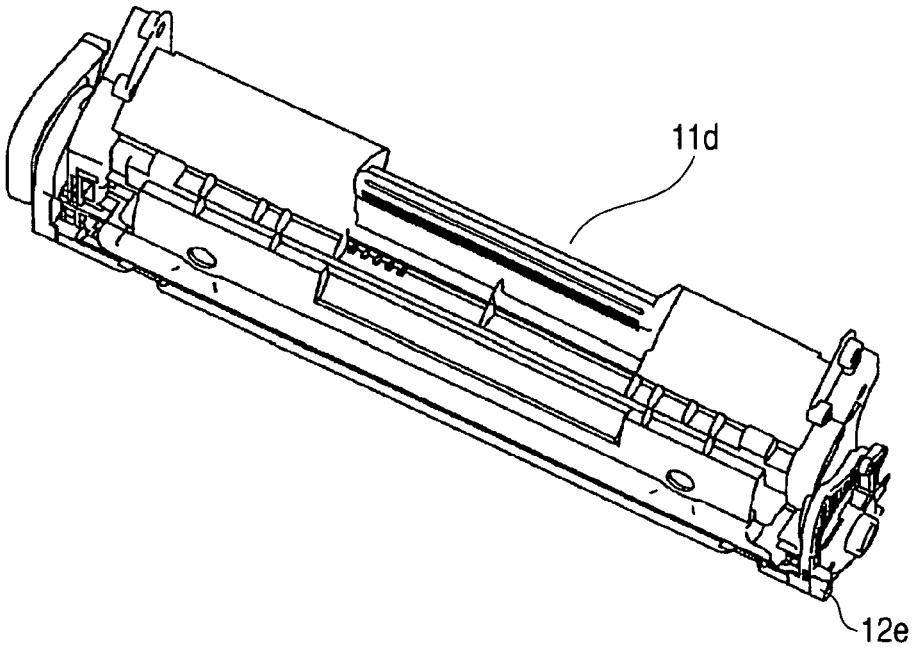
FIG. 5 is a perspective view 2 of cleaning means.

The drum shutter 12 is energized in the direction that the drum shutter 12 covers the photosensitive drum 7 by a spring force of a shutter spring 12*d*. Thereby, in the state where the process cartridge B is taken out of the apparatus main body, the drum shutter 12 keeps the state where it covers the transferring opening 9*a* of the photosensitive drum 7 as shown in FIG. 4 or 5. On the other hand, when the cartridge B is in the state where it is ready for image forming operation within the apparatus main body, the drum shutter 12 is rotated by drum shutter open/close means in the main body of the image forming apparatus and takes the attitude that the transferring opening 9*a* is exposed as shown in FIG. 1 or 2 and the photosensitive drum 7 can abut against the transferring roller 4.

Figure 16:
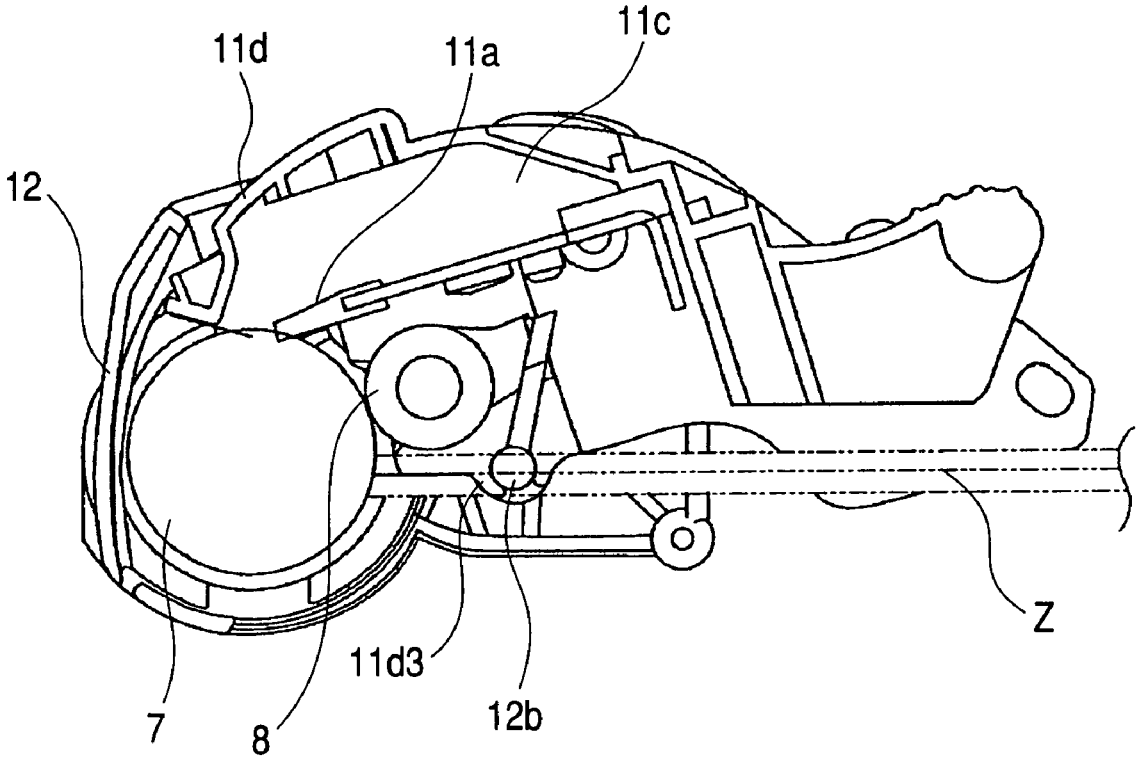
FIG. 16 is a schematic sectional view illustrating cleaning means and an optical path.
Figure 17:
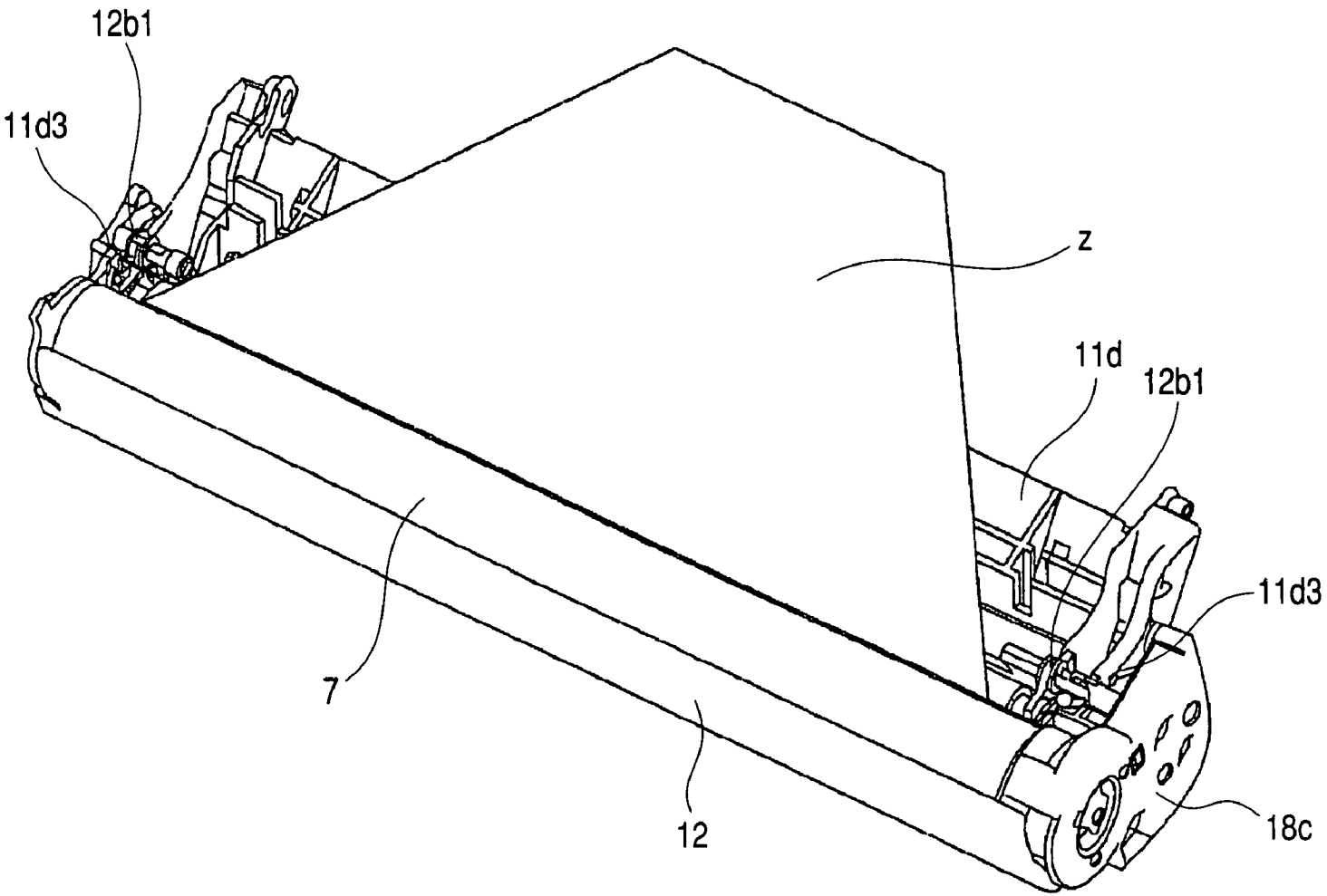
FIG. 17 is a schematic perspective view illustrating cleaning means and an optical path.

The mounting of the drum shutter 12 to the cleaning frame body (first frame body) 11*d* will be described further in detail. The cleaning frame body 11*d* is provided with guide portions 11*d*1 and 11*d*2 which movably hold the bearings 8*a* and 8*b*, which swingably support the electrostatic roller 8 as described above, in generally the same direction as the direction of the straight line connecting the center of the photosensitive drum 7 and the center of the electrostatic charging roller 8. The guide portions 11*d*1 and 11*d*2 are constructed such that the bearings 8*a* and 8*b* are pinched from two directions. The guide portions 11*d*1 and 11*d*2 are provided in the side close to the cleaning blade 11*a* and in the exposure side, that is, the side of the developing means 10. Of the guide portion 11*d*1 and 11*d*2, the guide portions 11*d*11 and 11*d*21 in the exposure side, that is, the side of the developing means 10 are provided with support portions 11*d*3 by which sliding portions 12*b*1 of the rotating shaft 12*b* of the drum shutter 12 are rotatably supported. The supporting portions 11*d*3, as shown in FIG. 16, are disposed to project to the side of the optical path Z that is irradiated from a scanner (not shown) when viewed from the rotating axis direction, that is, the sectional direction of the photosensitive drum 7, in order to expose the photosensitive drum 7. In addition, the longitudinal position of the supporting portions 11*d*3, as shown in FIG. 17, are disposed on the outside in the longitudinal direction of the optical path Z that is irradiated with light from the scanner (not shown). Thus, the supporting portions 11*d*3 are disposed in the space provided for the optical path Z provided between the developing means 10 and the cleaning means 11. This construction results in space savings of the cartridge. Each of the sliding portions 12*b*1 has a generally circular boss shape. Each of the sliding portions 12*b*1 is provided with a straight portion (D-cut portion) 12*b*11 on a part of the peripheral portion to be mounted on the supporting portion 11*d*3. The straight portion (D-cut portion) 12*b*11 is provided in two locations on the peripheral portion in generally parallel positions with each other. Each of the supporting portions 11*d*3 has the shape of a round hole in order to swingably support the sliding portion 12*b*1. In addition, a part of it has an open portion 11*d*31 which is open for mounting the drum shutter 12. The drum shutter 12 is mounted at the position where the straight portion of the sliding portion 12*b*1 is engaged with the open portion 11*d*31 of each of the supporting portions 11*d*3. Here, the engaging position is provided further downstream in the direction that the drum shutter 12 rotates from the position covering the transferring opening 9*a* to the position exposing the transferring opening 9*a* in the main body of the image forming apparatus. Therefore, for mounting the cartridge B on the apparatus main body, when the drum shutter 12 rotates from the position covering the transferring opening 9*a* to the position exposing the same, the straight portion (D-cut portion) of the sliding portion 12*b*1 will not mate with the open portion 11*d*31 of each of the supporting portions 11*b*3. Consequently, the drum shutter 12 will not become detached from the cleaning frame body (first frame body). In addition, when the cleaning means (in the first frame body) 11 and the developing means (in the second frame body) 10 are coupled to comprise the process cartridge B, end members 10*g* provided in the developing means 10 restrict the drum shutter 12 from further rotating from the position where the transferring opening 9*a* is opened. So the drum shutter 12 cannot rotate to the position where the straight portion (D-cut portion) 12*b*11 of the sliding portion 12*b*1 is coupled with the open portion 11*d*31 of each of the supporting portions 11*d*3. This also prevents the drum shutter 12 from becoming detached from the cleaning frame body 11*d*. In addition, the above described supporting portions 11*d*3 and guide portions 11*d*1 and 11*d*2 are provided at the position inside from the both ends in the thrust direction (photosensitive drum axis direction). Therefore, after coupling the cleaning means 11 and the developing means 10, it is difficult for an operator to access the supporting portions 11*d*3 from outside. This also prevents the drum shutter 12 from becoming detached from the cleaning frame body 11*d*. Further, the guide portions 11*d*1 and 11*d*2, in which the supporting portions 11*d*3 and the supporting portions 11*d*3 are provided, are provided at the inside in the thrust direction of an arms 10*g*7 of the end members 10*g* provided in the developing means 10.

Thereby, after coupling the cleaning means 11 and the developing means 10, it is difficult to access the supporting portion 11*d*3 from outside.

The above described embodiment is summarized as follows. The above described embodiment comprises a process cartridge comprising a cleaning frame body 11*d* (first frame body) swingably supporting an electrophotographic photosensitive drum 7, a toner developing frame body 10*f* (second frame body) swingably supporting a developing roller 10*d* and a drum shutter 12 which is movable between a protecting position for protecting the electrophotographic photosensitive drum 7 and a retracting position for retracting from the protecting position, wherein the drum shutter 12 is swingable about supporting portions 11*d*3 provided in the cleaning frame body 11*d*; the supporting portions 11*d*3 are provided projecting to the side of a space from the cleaning frame body 11*d* viewed from the axis direction of the photosensitive drum 7; and the supporting portions 11*d*3 are provided at the outside of an optical path Z for exposing the photosensitive drum 7 which is provided between the cleaning frame body 11*d* and the toner developing frame body 10*f* in the longitudinal direction of the photosensitive drum 7. In addition, the supporting portions 11*d*3 are disposed at the inside in the longitudinal direction of both sides of the cleaning frame body 11*d*. Further, the cleaning frame body 11*d* has an electrostatic charging roller 8 for charging the surface of the photosensitive drum 7 and an electrostatic roller supporting portions for supporting the electrostatic charging roller 8 are provided integrally with the cleaning frame body 11*d*, wherein the supporting portions 11*d*3 are provided on a part of the electrostatic charging roller supporting portions 8*d*. Furthermore, the drum shutter 12 has a protecting portion for protecting the photosensitive drum 7, supporting arm portions provided on the both ends in the longitudinal direction and connecting portions for connecting the supporting arm portions, wherein the connecting portions are provided between the cleaning frame body 11*d* and the toner developing frame body 10*f*.

The developing means 10 of the process cartridge B will now be described in detail.

Figure 6:
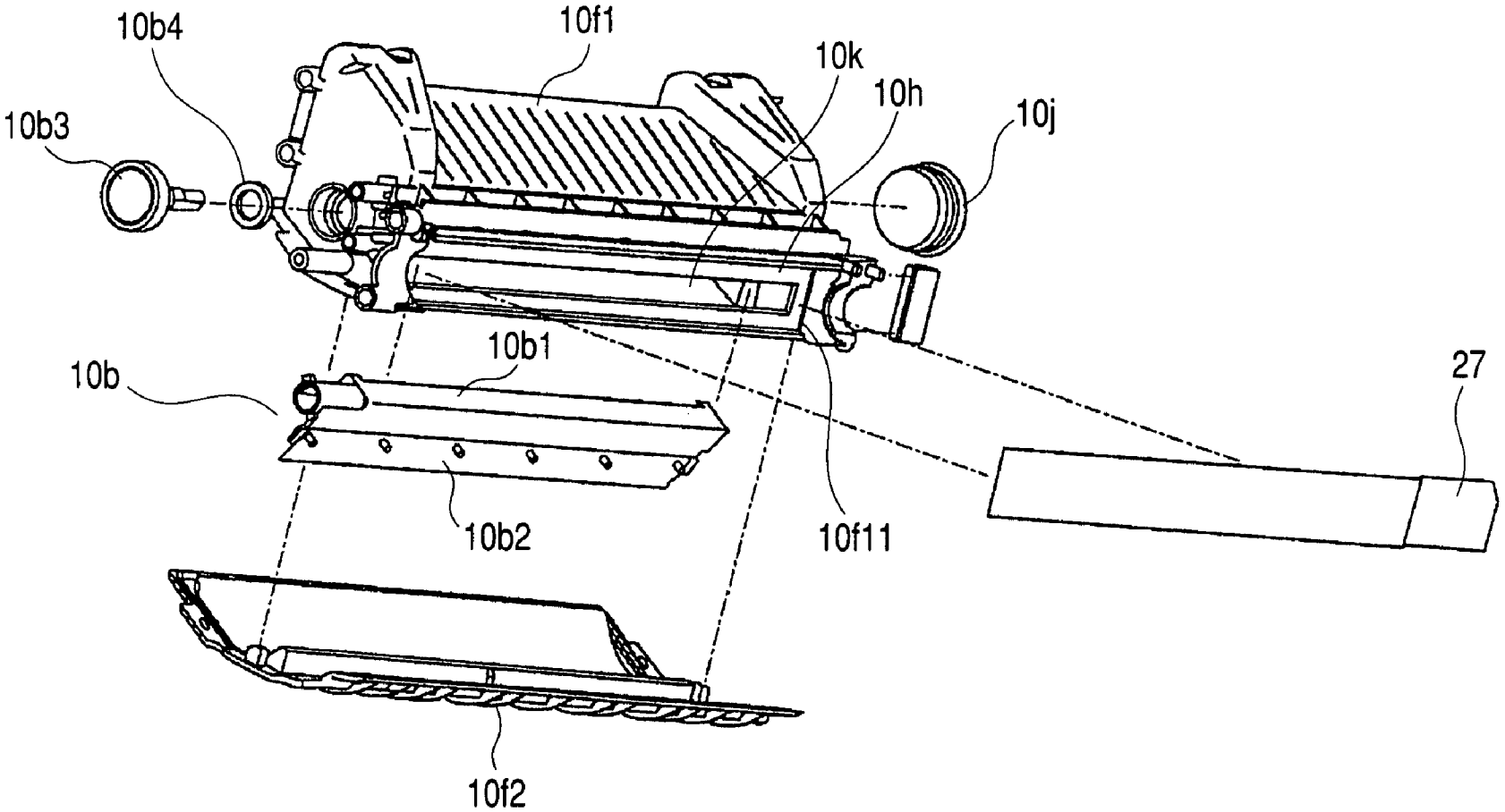
FIG. 6 is an assembly perspective view 1 of developing means.
Figure 7:
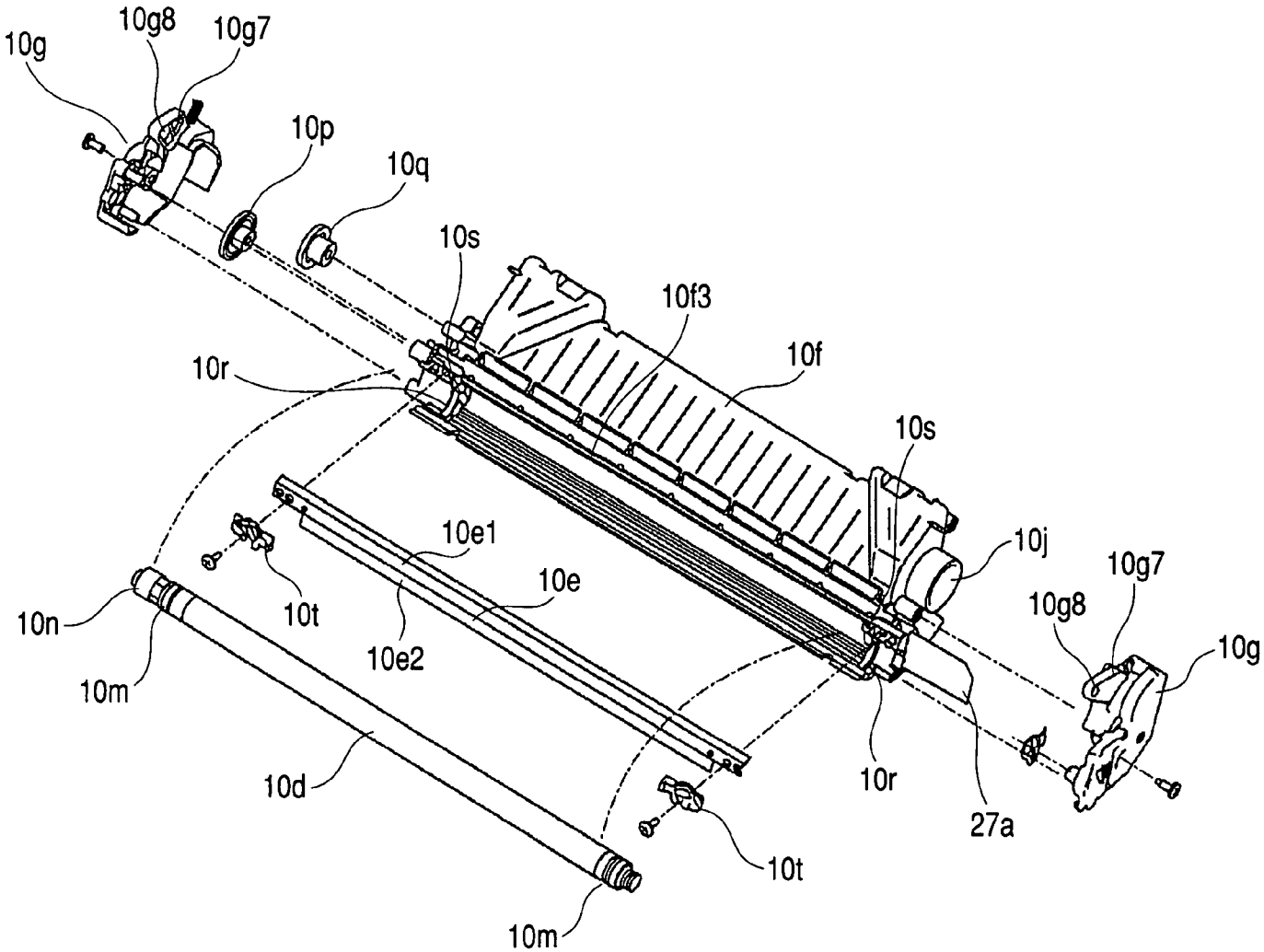
FIG. 7 is an assembly perspective view 2 of developing means.

The developing means 10, as shown in FIGS. 2, 6 and 7, constitutes a toner chamber (toner containing portion) 10*a* and a developing chamber 10*i* by combining a toner developing frame body 10*f*1 and a lid member 10*f*2.

The toner developing frame body 10*f*1 contains an agitation shaft 10*b*1 for supplying toner and a sheet member 10*b*2 fixed to the agitation shaft 10*b*1. A carrying gear 10*b*3 for restricting the transmission of the drive force and the agitation shaft 10*b*1 in the longitudinal direction is coupled to the agitation shaft 10*b*1 together with a sealing member 10*b*4 for preventing toner from leaking outside the toner developing frame body 10*f*1.

In addition, in the toner developing frame body 10*f*1, there is provided a toner-passing opening 10*k* through which the toner contained in the toner chamber 10*a* passes when supplied to the developing roller 10*d*.

The toner sealing member 27, as shown in FIG. 6, is fixed by heating to a seal mounting portion 10*h* along the four edges of the toner-passing opening 10*k*. In addition, at one end in the longitudinal direction of the toner developing frame body 10*f*1, there is provided a toner filling port (not shown) for filling toner to the toner chamber 10*a*. The toner filling port is sealed by a cap member 10*j* after filling toner.

Then, a description will be made using FIG. 7.

The toner developing frame body 10*f*1 is mounted with end seals 10*r* for preventing the leakage of toner at both ends of the developing roller 10*d*. Seal members 10*s* for preventing the toner from leaking at both ends of a developing blade 10*e* are adhered with double-faced tapes or the like to the toner developing frame body 10*f*1 and the lid member 10*f*2. The developing blade 10*e* is fastened with screws to the toner developing frame body 10*f*1 at both ends of a sheet metal portion 10*e*1 together with removing members 10*t* for removing toner at the ends of the developing roller 10*d*. Here, the rib 10*f*3 with a tapered tip of the toner developing frame body 10*f*1 has the dimension that is designed so that it is positively engaged in a developing blade rubber portion 10*e*2. Thus, the rubber portion 10*e*2 of the developing blade 10*e* and the toner developing frame body 10*f*1 remain sealed.

(Construction of End Members)

One of the end members 10*g* disposed at both sides in the longitudinal direction of the developing means 10 covers the gear train consisting of a developing roller gear 10*n* (refer to FIGS. 7 and 8) which is fixed to the end of the developing roller engaged with a drum gear (not shown) fixed to the end of the photosensitive drum 7 and two idler gears 10*p* and 10*q* for transmitting the drive force from the developing roller gear 10*n* to the carrying gear 10*b*3 of the toner carrying member 10*b*.

A pull-out portion 27*a* of the toner sealing member 27 is folded at one end in the longitudinal direction of the toner passing-opening 10*k* and pulled out to the outside through a hole 10*f*11 (refer to FIG. 6) of the toner developing frame body 10*f*1.

Figure 8:
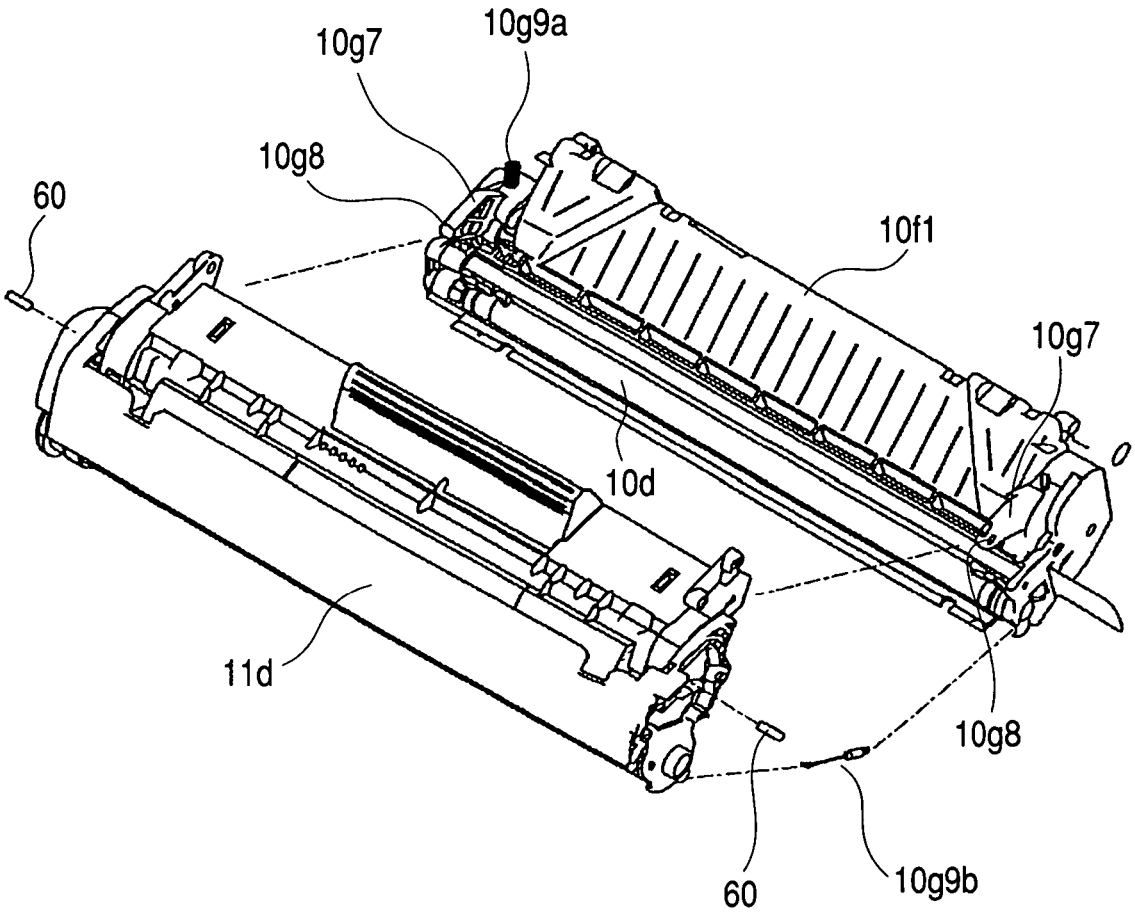
FIG. 8 is an assembly perspective view of a process cartridge.

Then, the thus constructed developing means 10 and cleaning means 11 are combined as described below, as shown in FIG. 8. The two end members 10*g* have arm portions 10*g*7 which are projecting toward the cleaning frame body 11*d*. The cleaning frame body 11*d* and the end members 10*g* are swingably coupled by pins 60 which are inserted into coupling holes 10*g*8 provided in the longitudinal direction at the tip of the arms 10*g*7 and coupling holes (not shown) provided on the cleaning frame body. A compression spring 10*g*9*a*, in which a spring stopper in one of the end members 10*g* is inserted inside the inner diameter thereof, is provided compressed against the cleaning frame body 11*d*. On the other end, a tension spring 10*g*9*b* is hung between the cleaning frame body 11*d* and the end member 10*g*. Thereby, the clearance-keeping members 10*m* at both sides of the developing roller 10*d* are brought into press-contact with the photosensitive drum 7. Consequently, the developing roller 10*d* and the photosensitive drum 7 are kept with a specific clearance. Thus, the process cartridge B is completed.

Figure 9:
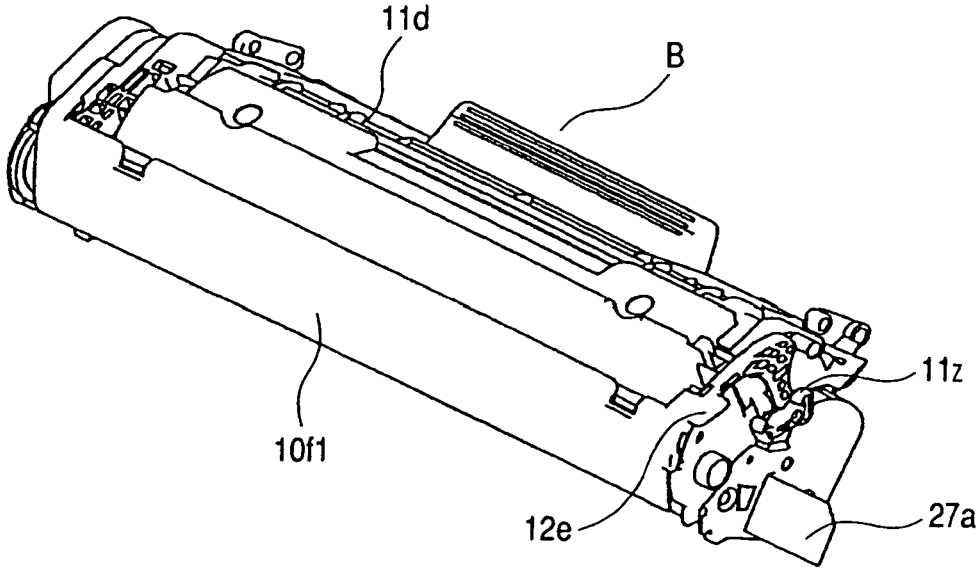
FIG. 9 is a final perspective view of a process cartridge.

When a user uses the cartridge B, the toner sealing end 27*a* (FIG. 9) is held and pulled out. Thereby, the toner-passing opening 10*k* of the toner developing frame body 10*f*1 is opened. Then, the toner in the toner chamber 10*a* is ready for being carried into the developing chamber 10*i*. Thus, the cartridge B is prepared to be inserted into the main body of the image forming apparatus A.

(Attaching and detaching of the process cartridge B to and from the main body of the image forming apparatus)

The cartridge B assembled as described above is mounted on the main body of the image forming apparatus A for forming images. The aspects of the mounting will be described with reference to FIGS. 9 to 11.

The bearing member 18*c* mounted on the cleaning frame body 11*d* of the cartridge B is provided with an arc portion (first abutting portion) 18*c*1 provided coaxilly with the drum center axis as a mounting guide for guiding the cartridge B when the cartridge B is mounted on the main body of the image forming apparatus A and a rotation stopping portion (second abutting portion) 18c2 for controlling the attitude positioned at the corner of the bearing member 18c and provided at the bottom of the cartridge frame body. Here, the rotation stopping portion 18c2 is arc shaped.

The arc portion 18c1 is positioned in the outside of the developing means 10 (developing roller 10d) in the drum axis direction of the developing means 10 (developing roller 10d) and disposed so as to overlap with at least a part of the developing means 10 (developing roller 10d) on the cross section. In addition, the rotation stopping portion 18c2 is located in the outside of the developing means 10 (developing roller 10d) and overlaps with it at all points in the drum axis direction of the developing means 10 (developing roller 10d). Further, the rotation stopping portion 18c2 is disposed at the rear in the insertion direction of the arc portion 18c1.

According to the present embodiment, a coupling means 70, which is a triangular coupling portion of the photosensitive drum 7 and which receives a driving force from the main body of the image forming apparatus A is disposed at the inside in the drum axis direction of the bearing member 18c.

Figure 10:
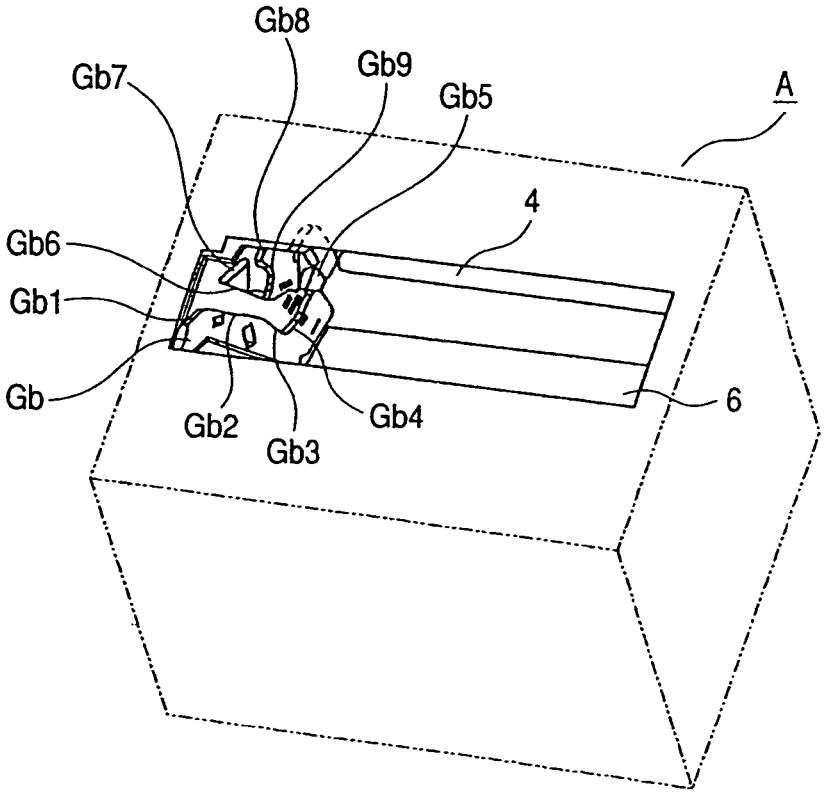
FIG. 10 is a schematic perspective view of the left guide of the main body of an image forming apparatus.
Figure 11:
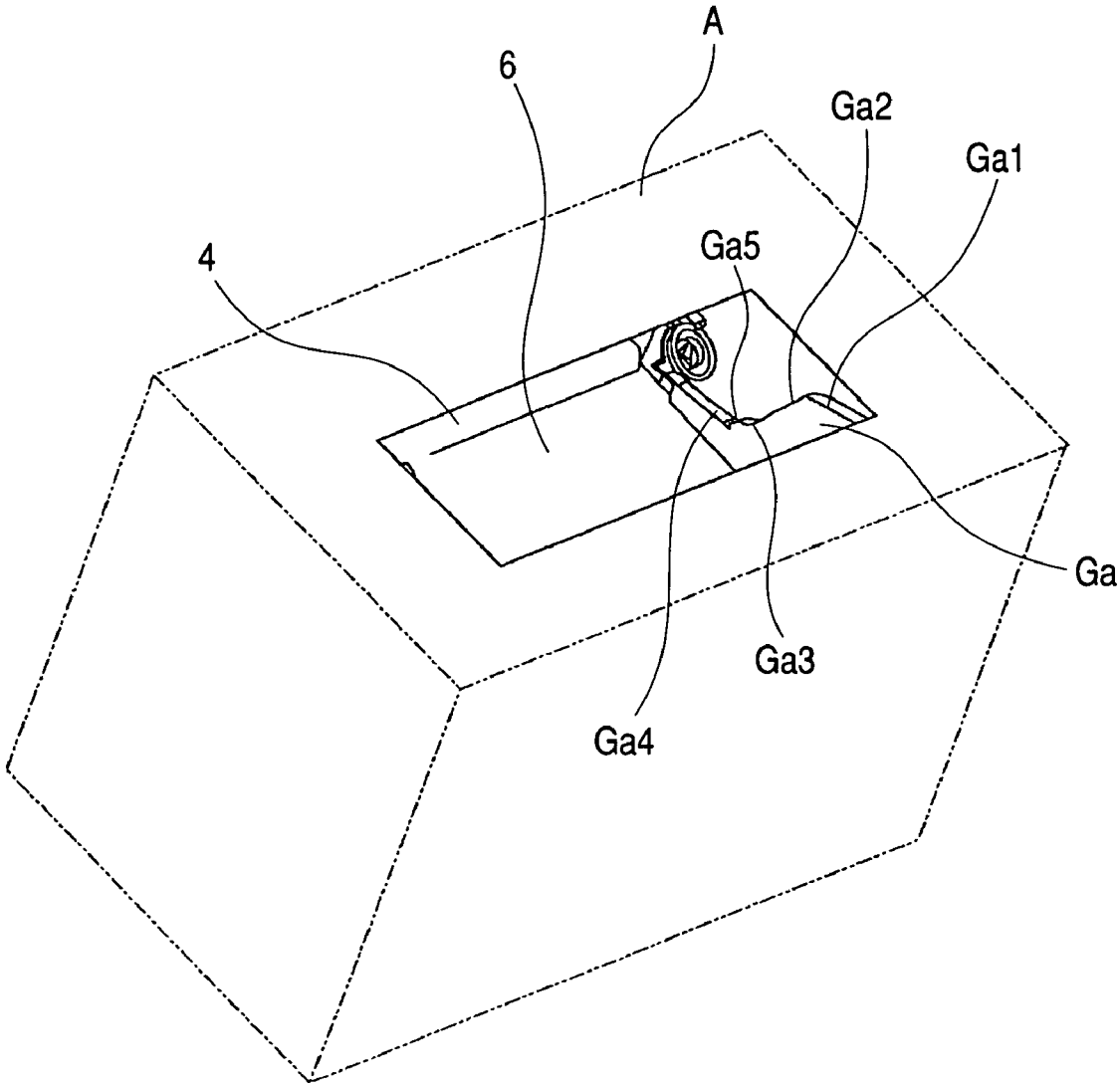
FIG. 11 is a schematic perspective view of the right guide of the main body of an image forming apparatus.
Figure 12:
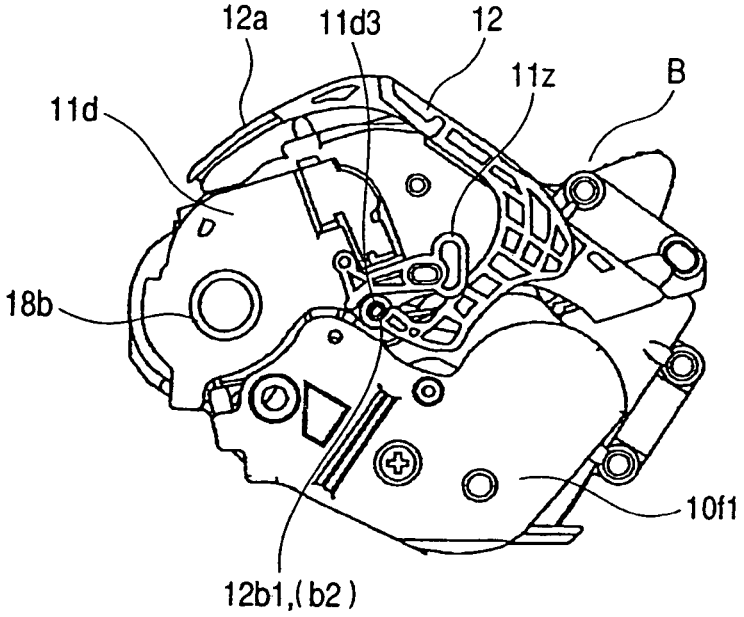
FIG. 12 is a left side view of a process cartridge.
Figure 13:
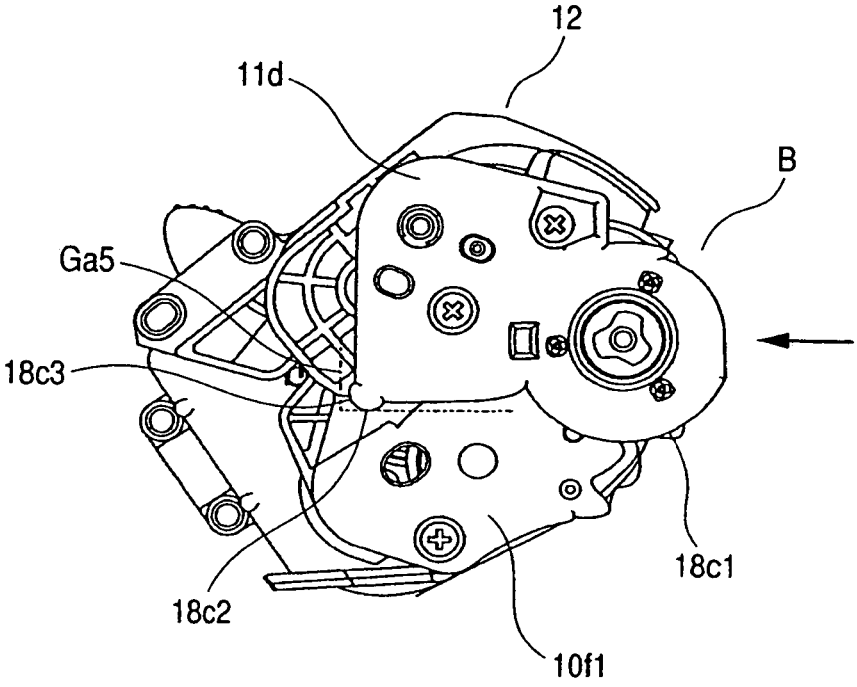
FIG. 13 is a right side view of a process cartridge.
Figure 14:
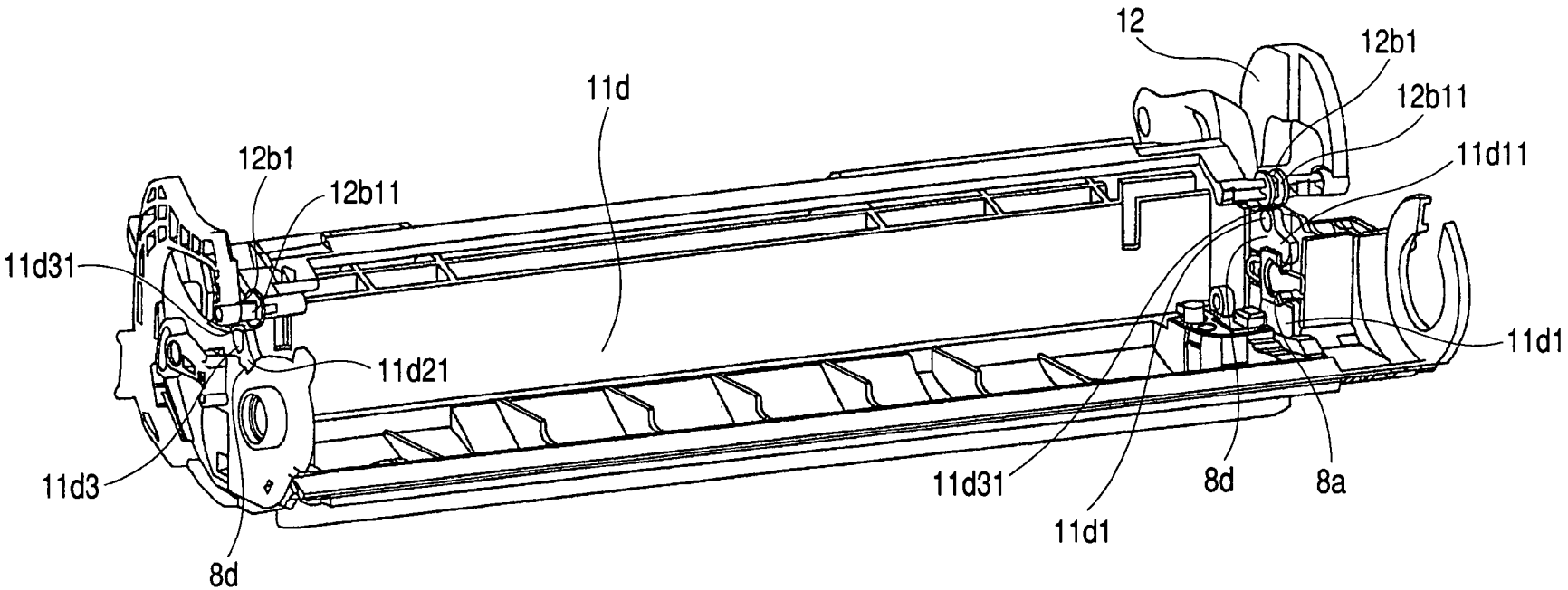
FIG. 14 is a schematic perspective view of a cleaning frame body and a drum shutter.
Figure 15:
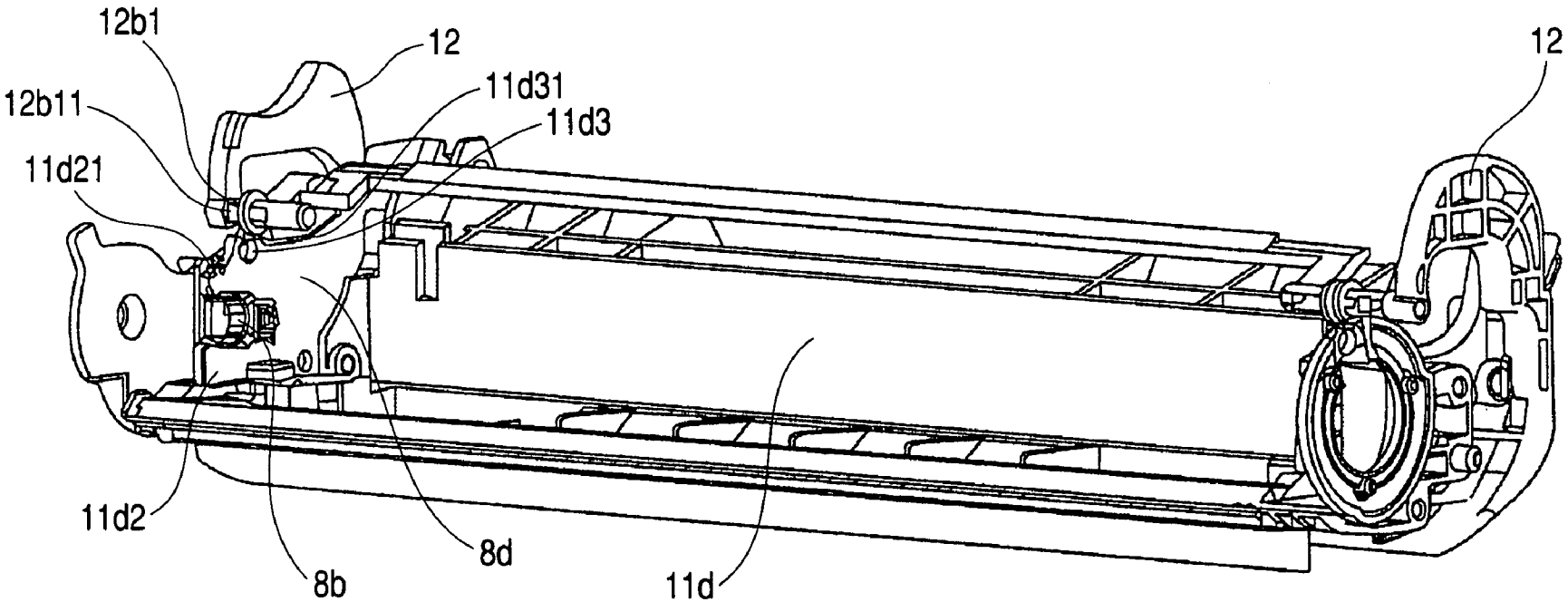
FIG. 15 is a schematic perspective view of a cleaning frame body and a drum shutter.

The main body of the image forming apparatus A, as shown in FIGS. 10 and 11, is provided with a guide member Ga as a first main body guide for guiding the process cartridge B to the image forming position (mounting position) by sliding the above described two portions, the arc portion 18c1 and the rotation stopping portion 18c2.

On the other hand, the drum frame body 102 on the side opposed in the drum axis direction to the bearing member 18c of the cartridge B is provided with a locating portion 18b for covering a drum supporting shaft 18d and a projection 11z for controlling the position of the cartridge B when the cartridge B is attached to and detached from the apparatus main body A.

In addition, the main body of the image forming apparatus A, as shown in FIGS. 10 and 11, is provided with a guide member Gb as a second main body guide so that the attitude of the cartridge B that is controlled at the bearing member 18c side is also kept at the opposed side and the cartridge B is not oblique to the drum axis direction.

Referring to FIGS. 9 to 13, the aspect of the mounting of the cartridge B to the apparatus main body A will now be described.

Firstly, a retractable door member (not shown) comprising the discharging portion 6 of the main body of the image forming apparatus A is opened to expose the guide members Ga and Gb. The arc portions 18c1 and 18c2 of the cartridge B are placed on a first guide surface Ga1 of the guide member Ga, which is a little curved in the front, such that the arc portion 18c of the cartridge B is in the front and the rotation stopping portion 18c2 is in the rear. Then, the locating portion 18b and the projection 11z of the cartridge B are placed on a first guide surface Gb1 of the other guide member Gb.

The cartridge B is pushed into the main body of the image forming apparatus A while keeping this state.

Thereby, the arc portion 18c1 and rotation stopping portion 18c2 are guided by sliding to the mounting position defined by a second guide surface Ga2 provided in a generally vertical direction to the first guide surface Ga1, a third guide surface Ga3 provided in a generally horizontal direction from the second guide surface Ga2 and a curved fourth guide surface Ga4 provided adjacent to the third guide surface Ga3.

Thereby, the cartridge B abuts the fourth guide surface Ga4 as a first main body-receiving portion at the arc portion 18c1. In addition, the cartridge B is placed on the third guide surface Ga3 in the state where a rear curved portion of the rotation stopping portion 18c2 abuts the second guide surface Ga2. In this placement, the transferring roller 4 and the photosensitive drum 7 are in a state abutted with each other. Thus, a repulsive force is imparted to the cartridge B in the direction of the arrow in FIG. 13. At this time, a third abutting porting 18c3 abuts a fifth guide surface Ga5 located adjacent to the Ga3 to prevent a displacement of the position of the cartridge B. The third abutting portion 18c3 may be integral or separate with the second abutting portion 18c2 which is the rotation stopping portion.

On the other hand, the locating portion 18b and the projection 11z on the opposite side of the cartridge B are guided by sliding to the mounting position defined by a plurality of guide surfaces, sequentially provided from the first guide surface Gb1, such as a second guide surface Gb2, a third guide surface Gb3 and a fourth guide surface Gb4. Finally, the locating portion 18b is guided to a locating position Gb5.

As described above, the cartridge B is mounted on the mounting position relative to the apparatus main body A. Then, when the door of the apparatus main body A is closed, a triangle coupling 7a1 of the cartridge B engages in a drive transmitting member having a cross section of a generally triangle distorted recess (not shown). Thereby, the rotating drive force is transmitted to the cartridge B from the apparatus main body A.

Thereby, the cartridge B rotates about the axis of the photosensitive drum 7. At this time, a clearance is formed between the third abutting portion 18c3 of the bearing member 18c which has been abutting the guide and the guide surface Ga5. Thus, the rotation stopping portion 18c2 of the bearing member 18c abuts the third guide surface Ga3 which is a defining surface of the guide member Ga to locate the direction of rotation.

On the other hand, when mounting the cartridge B, the locating portion 18b on the drum axis of the drum frame body 102 on the opposite side in the drum axis direction is housed in a U-shaped groove which is a locating portion provided in the fourth guide surface Gb4. Thereby, the locating portion 18b is located by a presser bar spring (not shown) for suppressing the repulsive force or run-out of the transferring roller 4. The projection 11z of the drum frame body C is designed such that it has the position and the size that will not abut the apparatus main body A within the accuracy of parts and assembly.

Further, during the aspect of the mounting as above described, the projection 12e of the drum shutter 12 abuts a first shutter guide surface Gb7 provided in the guide Gb. Thereby, the action of rotation of the shutter 12 is started. Then, with the aspect of the mounting of the cartridge B, the projection 12e abuts a second shutter guide surface Gb8 and slides. Finally, the shutter 12 is held in the state shown in FIGS. 1 and 2 by a third guide surface Gb9.

The above described attitude becomes the attitude of the cartridge B during the image forming, and the image forming is started.

When the cartridge B is removed from the apparatus main body A, it is removed from the apparatus position to the outside of the apparatus along the corresponding guides Ga and Gb of the apparatus main body A by the reverse operation to the above described mounting operation. At the same time, the shutter 12 is rotated and closed successively so as to cover the photosensitive drum 7.

Accidentally, when the cartridge B is taken out of the mounting position, the projection 11z is brought into contact with the fifth guide surface Gb5 on the upper surface of the guide member Gb and restricts the front side in the taking-out direction of the cartridge B from rotating upward more than a specific amount.

Moreover, the case for forming a monochrome image is illustrated in the cartridge shown in the above described embodiment, but the cartridge according to the present invention can be suitably applied to the cartridge in which a plurality of developing means are provided and images of a plurality of colors (e.g. two-color image, three-color image or full-color, etc.) are formed.

Moreover, the electrophotographic photosensitive member is not limited to the photosensitive drum and includes the followings. A photoconductor is used as a photosensitive member. The photoconductor includes, for example, amorphous silicon, amorphous selenium, zinc oxide, titanium oxide and an organic photoconductor (OPC). As the shape for loading the photosensitive member, for example, a drum-shape or a belt-shape is used. For example, a drum-type photosensitive member is prepared by vapor-depositing or coating a photoconductor on a cylinder made of an aluminum alloy or the like.

Moreover, as a developing method, various known developing methods can be used such as two-component magnetic brush development, cascade development, touch down development and cloud development.

Moreover, as the construction of the electrostatic charging means, a so called contact electrification process has been used in the above described embodiment. However, as a different construction, a conventionally used construction can naturally be used, in which three sides of the periphery of a tungsten wire are applied with a metal shield such as aluminum, and positive or negative ions generated by applying high voltage to the tungsten wire are transferred to the surface of a photosensitive drum, charging the surface of the drum uniformly.

Further, the electrostatic charging means may include, other than the roller-type, a blade (electrostatic charging blade), a pad-type, a block-type, a rod-type, a wire-type or the like.

Further, the method for cleaning the residual toner on the photosensitive drum may include the cleaning means using a blade, a fur brush, a magnetic brush or the like.

Moreover, the above described process cartridge means the cartridge in which an electrophotographic sensitive drum and developing means as process means are integrally assembled and which is made detachably attachable to the apparatus main body. The process cartridge can be detachably attachable to the apparatus main body by a user itself. Therefore, the maintenance of the apparatus main body can be carried out by the user itself.

Furthermore, although a laser beam printer has been illustrated as an electrophotographic image forming apparatus in the above described embodiment, the present invention need not be limited by the laser beam printer and can naturally be used for electrophotographic image forming apparatuses such as, for example, an electrophotographic copier, an electrophotographic printer such as an LED printer, a facsimile apparatus, a word processor or multiple function machines thereof (such as a multifunction printer).

According to the above described embodiment, portions for rotatably supporting a drum shutter can be located at the inside of the both ends in the longitudinal direction by providing the portions for rotatably supporting a drum shutter at the position adjacent to the portions for supporting an electrostatic charging roller in a cleaning frame body. Consequently, after a developing means is coupled, direct access to the supporting portions becomes difficult. Thus, it is possible to prevent the drum shutter from being accidentally detached from the cleaning frame body.

Moreover, the portions for rotatably supporting the drum shutter, among the guide portions for supporting the electrostatic charging roller, are provided on the side opposed to the developing means. Therefore, after coupled with the developing means, it becomes difficult to easily remove the drum shutter. Thus, it is possible to prevent the drum shutter from being accidentally detached from the cleaning frame body. As described above, the drum shutter is not easily detached according to the present invention.

What is claimed is:

1. A process cartridge detachably attachable to a main body of an electrophotographic image forming apparatus, comprising:

an electrophotographic photosensitive drum;

a first unit supporting said electrophotographic photosensitive drum;

a developing roller configured and positioned to develop, with a developer, an electrostatic latent image formed on said electrophotographic photosensitive drum;

a second unit supporting said developing roller and coupled to said first unit;

an optical path provided between said first unit and said second unit and configured and positioned to pass light emitted from the main body of the electrophotographic image forming apparatus in order to expose said electrophotographic photosensitive drum to the light;

a drum shutter movable between a protecting position for protecting said electrophotographic photosensitive drum and a retracting position retracted from the protecting position;

a supported portion provided in said drum shutter;

a supporting portion configured and positioned to support said supported portion in order to move said drum shutter between the protecting position and the retracting position, said supporting portion being positioned outside said optical path in a longitudinal direction of said electrophotographic photosensitive drum and being positioned between said first unit and said second unit when said process cartridge is viewed along the longitudinal direction of said electrophotographic photosensitive drum; and an open portion provided in said supporting portion to mount said supported portion to said supporting portion, said open portion being arranged to pass through said supported portion under a condition that said drum shutter is positioned at a mount position deviated from and between said protecting position and said retracting position before coupling said first unit and said second unit, and wherein when said first unit and said second unit are coupled, said drum shutter is movable between said protecting position and said retracting position and said drum shutter is restricted not to move to said mount position due to contact between said drum shutter and said second unit when said drum shutter is moving toward said mount position from between said protecting position and said retracting position.

2. The process cartridge according to claim 1, wherein said supporting portion is disposed inside both sides of said first unit in the longitudinal direction.

3. The process cartridge according to claim 1 or 2, wherein said first unit has:

an electrostatic charging roller configured and positioned to charge a surface of said electrophotographic photosensitive drum; and an electrostatic charging roller supporting portion supporting said electrostatic charging roller, and wherein said supporting portion is provided in a part of said electrostatic charging roller supporting portion.

4. The process cartridge according to claim 1, wherein said drum shutter has:

a protecting portion protecting said electrophotographic photosensitive drum;

supporting arm portions provided on both sides of said drum shutter in the longitudinal direction; and a coupling portion coupling said supporting arm portions.

5. An electrophotographic image forming apparatus for forming an image on a recording medium, comprising:

(i) a optical light emitting portion;

(ii) a mounting portion;

(iii) a process cartridge mounted so as to be detachably attached to said mounting portion, said process cartridge comprising:

an electrophotographic photosensitive drum;

a first unit supporting said electrophotographic photosensitive drum;

a developing roller configured and positioned to develop, with a developer, an electrostatic latent image formed on said electrophotographic photosensitive drum;

a second unit supporting said developing roller and coupled to said first unit;

an optical path provided between said first unit and said second unit and configured and positioned to pass light emitted from said optical light emitting portion in order to expose said electrophotographic photosensitive drum to the light;

a drum shutter movable between a protecting position for protecting said electrophotographic photosensitive drum and a retracting position retracted from the protecting position;

a supported portion provided in said drum shutter;

a supporting portion configured and positioned to support said supported portion in order to move said drum shutter between the protecting position and the retracting position, said supporting portion being positioned outside said optical path in a longitudinal direction of said electrophotographic photosensitive drum and being positioned between said first unit and said second unit when viewed from a direction along the longitudinal direction; and an open portion provided in said supporting portion to mount said supported portion to said supporting portion, said open portion being arranged to pass through said supported portion under a condition that said drum shutter is positioned at a mount position deviated from and between said protecting position and said retracting position before coupling said first unit and said second unit, and wherein when said first unit and said second unit are coupled, said drum shutter is movable between said protecting position and said retracting position and said drum shutter is restricted to not move to said mount position due to contact between said drum shutter and said second unit when said drum shutter is moving toward said mount position from between said protecting position and said retracting position; and (iv) a conveying portion conveying the recording medium.

* * * * *

UNITED STATES PATENT AND TRADEMARK OFFICE

CERTIFICATE OF CORRECTION

PATENT NO. : 6,983,114 B2
APPLICATION NO. : 10/687806
DATED : January 3, 2006
INVENTOR(S) : Arimitsu It is certified that error appears in the above-identified patent and that said Letters Patent is hereby corrected as shown below:

COLUMN 1
Line 55, “sensitive” should read --photosensitive--.

COLUMN 3
Line 59, “sensitive” should read --photosensitive--.
Line 61, “sensitive” should read --photosensitive--.

COLUMN 11
Line 12, “(e.g.” should read --(e.g.,--.
Line 16, “followings.” should read --following.--.
Line 47, “sensitive” should read --photosensitive--.

COLUMN 13
Line 17, “a” should read --an--.

COLUMN 14
Line 13, “from a direction” should be deleted.
Line 14, “direction;” should read --direction of said electrophotographic photosensitive drum;--.

Signed and Sealed this

Eighth Day of August, 2006

JON W. DUDAS
*Director of the United States Patent and Trademark Office*